United States Patent [19]

Sato

[11] 4,149,462

[45] Apr. 17, 1979

[54] CONSTANT PRESSURE MECHANISM FOR PRINTING OPERATION OF LABEL PRINTING MACHINE

[75] Inventor: Yo Sato, Tokyo, Japan

[73] Assignee: Kabushiki Kaisha Sato Kenkyusho, Tokyo, Japan

[21] Appl. No.: 796,665

[22] Filed: May 13, 1977

[30] Foreign Application Priority Data

May 17, 1976 [JP] Japan ..... 51/056304

[51] Int. Cl.[2] ..... B41J 5/00

[52] U.S. Cl. ..... 101/291; 101/288; 400/457; 156/384

[58] Field of Search ..... 197/33, 43; 156/384; 101/288, 316

[56] References Cited

U.S. PATENT DOCUMENTS

| | | | |
|---|---|---|---|
| 2,384,707 | 9/1945 | Sheet | 101/3 R |
| 2,558,616 | 6/1951 | Johnson | 101/3 R |
| 2,682,944 | 7/1954 | Schremp | 197/33 |
| 3,362,326 | 1/1968 | Delpho et al. | 101/316 |
| 3,734,262 | 5/1973 | Dall et al. | 197/43 |
| 3,793,946 | 2/1974 | Sheffield | 101/111 |
| 3,911,817 | 10/1975 | Becker et al. | 101/288 |
| 4,072,105 | 2/1978 | Becker et al. | 101/288 |

FOREIGN PATENT DOCUMENTS

| | | | |
|---|---|---|---|
| 1055211 | 1/1967 | United Kingdom | 197/43 |

*Primary Examiner*—William Pieprz

*Attorney, Agent, or Firm*—Ostrolenk, Faber, Gerb & Soffen

[57] ABSTRACT

A constant pressure mechanism for the printing operation of a label printing machine; the machine has a hand lever, a printing lever, a printing head attached to the printing lever, a constant pressure spring secured between the hand lever and the printing lever and a platen to carry a label strip; when the hand lever is squeezed, the printing lever is turned by the force of the constant pressure spring to strike the printing head against the label strip on the platen, and immediately after the printing operation, the printing head is slightly released from the platen by means of releasing members.

12 Claims, 9 Drawing Figures

CONSTANT PRESSURE MECHANISM FOR PRINTING OPERATION OF LABEL PRINTING MACHINE

BACKGROUND OF THE INVENTION

This invention relates to a constant printing pressure mechanism for a label printing machine and particularly a portable label printing and applying machine. One such label printing and applying machine is of the type in which a pressure-sensitive, self-adhesive label strip, having a backing strip, is printed by the squeezing operation of a hand lever, and the printed label is then peeled from the backing strip and applied to the surface of a desired article. But other types of machines and of imprintable labels can be used with the invention.

In some conventional label printing machines of this type, the hand lever and the printing lever are independent from each other. Both of these levers are often rotatably supported by a single shaft. A constant pressure spring is interposed between both levers and a pressure receiving device, i.e. the platen, is attached to the machine so as to receive the printing pressure of a printing head with a certain force. In such a label printing machine, when the hand lever is squeezed, the printing lever is turned down with the actuation of the constant pressure spring so that the printing head attached to the lever strikes the platen with a constant printing pressure.

Even though constant pressure printing is possible by striking the printing head against the platen, irrespective of the strength of squeezing of the hand lever, the operations following the constant printing action are not satisfactory in the above system. In this system, the printing head returns after the printing, together with the releasing of the hand lever. If the hand lever is squeezed for a long time, the type face of the printing head maintains prolonged contact with the printed label surface. Accordingly, excessive ink is absorbed by the label surface which may blot or blur the ink.

Furthermore, the printing head may bounce on the printed label due to the impact of printing action so that double printing may occur. This would adversely affect the accuracy of printing.

BRIEF SUMMARY OF THE INVENTION

It is, therefore, the primary object of the present invention to provide a constant pressure mechanism for the printing operation of a label printing machine, wherein clear and precise printing can be attained irrespective of the strength and the length of time of the squeezing of the hand lever.

Another object of the present invention is to provide such a constant printing pressure mechanism wherein just after the printing, the printing head is separated from the printed label surface without causing any ink blots or stains.

A further object of the present invention is to provide such a constant printing pressure mechanism which is simple in structure and easily built into a label printing machine.

In accordance with the present invention, the constant pressure mechanism comprises a hand lever which is pivotally turned through a certain angle relative to a hand grip by squeezing of the hand lever, a printing lever pivotally secured on the same shaft as the hand lever, a constant pressure spring fitted in a space between the hand lever and the printing lever, a printing head attached to the free end of the printing lever, and a platen which receives the printing pressure of the printing head, and with a label strip interposed between the printing head and the platen.

The constant pressure mechanism is characterized in that, when the hand lever is squeezed to move through a certain angle, the printing lever is turned by the force of the constant pressure spring to strike the printing head against the label strip carried on the platen. Further, the constant pressure mechanism is provided with a means to separate the printing head from the platen just after the printing stroke, thereby attaining momentary contact of the printing head with the label strip on the platen and preventing staining of label strip with printing ink.

There are abutments carrying release springs that are attached to the portions of the hand lever and the printing lever near the ends thereof attached on the pivot shaft so as to separate the printing head from the printed label immediately after the printing stroke. Further, the platen is provided with a pair of release spring plates so as to lift up the printing head immediately after the printing stroke of the machine.

By reason of inclusion of all of the foregoing, this invention is an improvement over application Ser. No. 750,845, filed Dec. 15, 1976.

BRIEF DESCRIPTION OF THE DRAWINGS

These and other objects and features of the invention will become more apparent from the following description taken in connection with the accompanying drawings, in which:

FIGS. 7 to 9 are explanatory drawings showing the coaction between the printing head and a platen, in which:

FIG. 7 is a partially cross-sectional, front view of the printing head and the platen in a rest position;

FIG. 8 is the same view of the printing head and the platen in a printing position; and FIG. 9 is the same view of the printing head and the platen in a released state immediately after the printing sroke.

DESCRIPTION OF PREFERRED EMBODIMENTS

Figure 1:
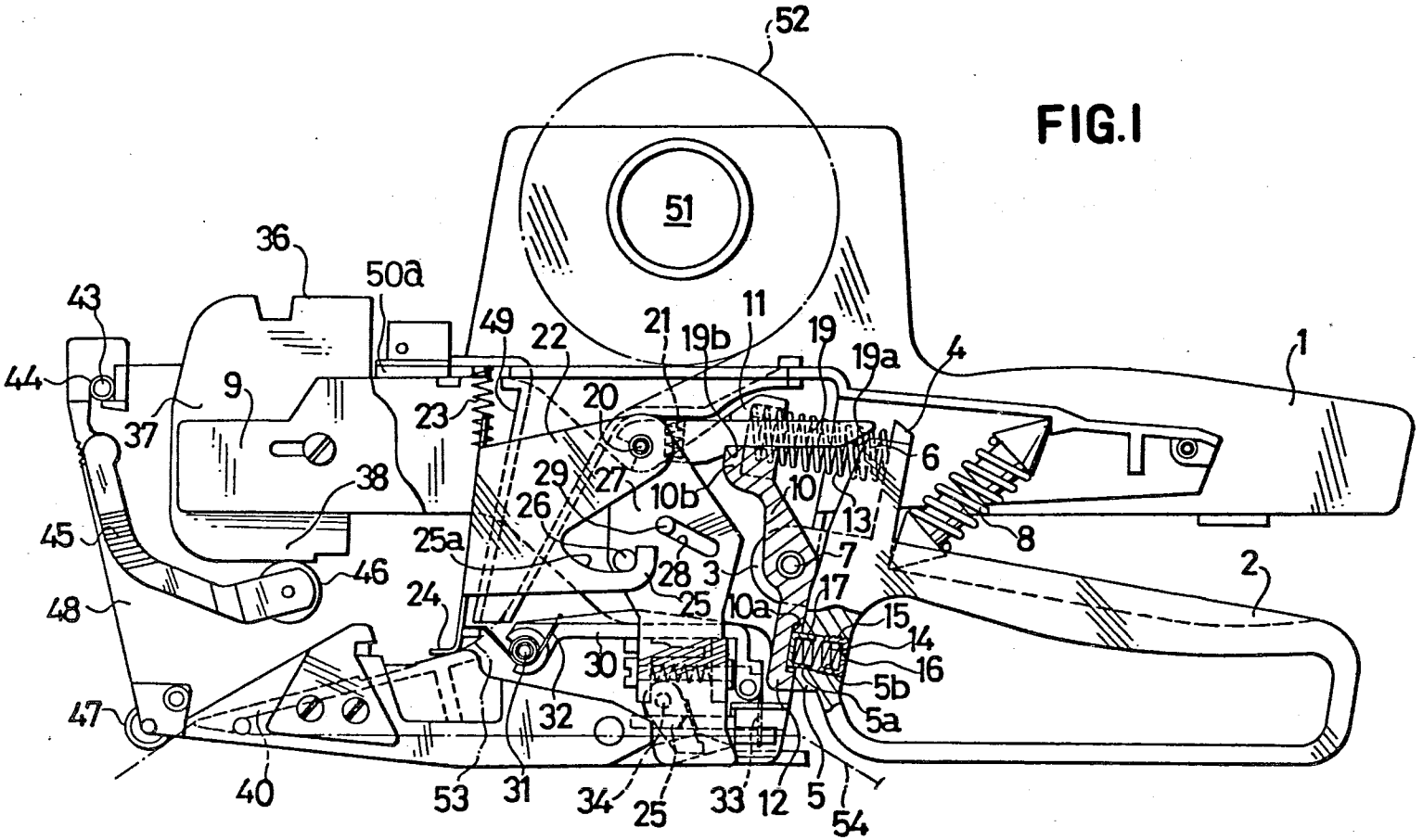
FIG. 1 is a partially cross-sectional, side view of a label printing machine in a rest position with the near side machine frame removed and which machine is provided with a first embodiment of the constant pressure mechanism of the invention.

The preferred embodiments of the present invention are now described with reference to the accompanying drawings.

A first embodiment of constant pressure mechanism is shown in FIGS. 1 to 4. A label printing machine is provided with a hand grip 1 and a hand lever 2 on the rear side (right side in FIG. 1). Between the hand grip 1 and the hand lever 2 is a return spring 8 which urges the hand lever 2 toward the rest (downward) position when it is released. The hand lever 2 has a pivoted (left-hand) end 3 which is pivotally carried by a pivot shaft 7 attached between a pair of opposed machine frames 48, so that the hand lever 2 can be rocked up and down about shaft 7. At and extending above the front end portion of the hand lever 2 is a pair of spaced apart, parallel, upstanding lugs 6.

There is a printing lever 9, sometimes known as a yoke, which supports the printing head 36 of the label printing machine. The printing head is carried on the front (left) end of printing lever 9. The printing lever has a rear pivot portion 10, which is also pivotally supported by the pivot shaft 7. When the hand lever 2 is squeezed and released, the printing lever 9 is moved by the working of a constant pressure spring 13, release springs 14 and the return spring 8.

On the upper front (left) end portion of the hand lever 2, above the pivot shaft 7 and at the rear of and placed between the lugs 6, there is an upwardly projecting abutment strut 4 attached to the hand lever 2. Another upwardly projecting abutment strut 11 is formed at the pivoted (rear, right) portion 10 of the printing lever 9. The struts 4 and 11 are opposed. The constant pressure spring 13 is interposed between both of the opposed abutment struts 4 and 11. Below the pivot shaft 7, opposed abutments 5 and 12 are formed on the lever 2 and printing lever 9, respectively. There is a pair of a abutments 5 and an opposed pair of abutments 12, and the pair of abutments symmetrically arranged, one on the right side and one on the left side. When the label printing machine is in the rest position of FIG. 1, the abutments 5 and 12 are brought into contact with each other by the force of the return spring 8 and the constant pressure spring 13.

In both of the abutments 5, there are front (or leftward) facing fitting holes 5*a*, having rear inner screw threads 5*b*. Opposed to the holes 5*a* are the fitting grooves 10*a* in both of the abutments 12. A pair of cylindrical spring holders 17 (see FIG. 4) having radial projections 18 are fitted into the fitting grooves 10*a*. Hollow sleeve screws 15, having respective adjusting grooves 16, are engaged with the rear inner screw threads 5*b*. Between each pair comprised of the sleeve screw 15 and the spring holder 17, a release spring 14 is inserted. A portion of each spring holder 17 is inserted into a front fitting hole 5*a* of the hand lever 2. The spring force of the release spring 14 can be controlled with the adjusting groove 16 that is formed in the rear end face of the sleeve screw 15 by using, for example, a screwdriver.

A shaft 20 that is attached to the machine frames 48 pivotally supports a pair of spaced apart action levers 19 which actuate the constant pressure spring 13, a label holding member 22 carrying a tape-like label strip 53, and a rocking member 27 which advances the label strip 53 a constant distance for each stroke of the hand lever.

Each action lever 19 extends toward and cooperates with its respective lug 6 that is formed on the front portion of the hand lever 2. The action levers 19 are always urged down (clockwise) by a spring 21. Each lever 19 has an engaging face 19*a* at the lower, rear tip end thereof. When the hand lever 2 is in the rest position, the engaging face 19*a* and the action lug 6 of the hand lever 2 are separated from each other. At the same time, the engaging recess 19*b* beneath each action lever 19 is brought into contact with the engaging portion 10*b* that is formed on the top end of the pivoted portion 10 of the printing lever 9, by the downward force of the above-mentioned spring 21.

A push-down spring 23 is attached between the upper front portion of a label holding member 22 and a label guide 49. There is a label pushing member 24 depending beneath the label holding member 22. By the force of the spring 23, the label pushing member 24 is pressed toward a platen 40 that is fixed to the machine frame 48. This prevents idle movement of the label strip 53. The rear part of the label holding member 22 is provided with a hook shaped pressure-receiving section 25, with which a stop pin 26 fixed on the below described rocking member 27 is engaged. The pressure-receiving section 25 has a curved upper guide surface 25*a* for guiding the stop pin 26.

The rocking member 27 has a guide slot 28 which receives the guide pin 29 that is attached to the printing lever 9. Thus, motion of the rocking member 27 is interlocked with the turning of the printing lever 9. To the lower portion of the rocking member 27 is attached a transferring device which intermittently pulls the backing strip 54 backward. The backing strip, which constitutes the lower layer of the label strip 53 is peeled and folded back near the front end of the platen 40.

More particularly, there is a transferring pawl 35 which is carried by a pin 34. The backing strip 54 is caught by the pawl 35 which moves the backing strip 54 rearwardly. The label strip 53 is advanced a certain distance to provide the platen 40 with a new label surface. At the same time, the printed label is peeled from the backing strip 54 by the above-mentioned folding back of the backing strip 54, and the peeled label is advanced on the application roller 47 attached at the front portion of the labeling machine.

With reference to the rocking member 27, a backing strip arresting member 30 is pivotally secured to a shaft 31 that is attached to the machine frame 48. The free end of the arresting member 30 is always urged down by the force of a spring 32 within the vacant space of the rocking member 27, so that the pawl 33 at the tip end of the member 30 is pressed to the backing strip 54, thereby preventing the backing strip 54 from reverse movement toward the front of the platen 40.

A printing head 36 is attached to the front end of the printing lever 9. The type face 38 of printing head 36 faces toward the platen 40. Ink is applied to the type face by an inking roller 46. The inking roller 46 is rotatably supported by roller arms 45 that are pivotally secured to a shaft 43 attached to the machine frame 48. By the force of a spring 44 fitted to the shaft 43, the inking roller 46 is always urged up toward the type face 38.

The upper portion of the label printing machine is provided with a label strip supporting section 51, which carries a rolled label strip 52 consisting of a length of tape-like label strip 53. The rolled label strip 52 is rotatable in the label supporting section 51 and it is delivered through the label guide 49 to the upper surface of the platen 40 through the rocking motion of the rocking member 27.

The operation of the constant printing pressure mechanism is now described.

Figure 2:
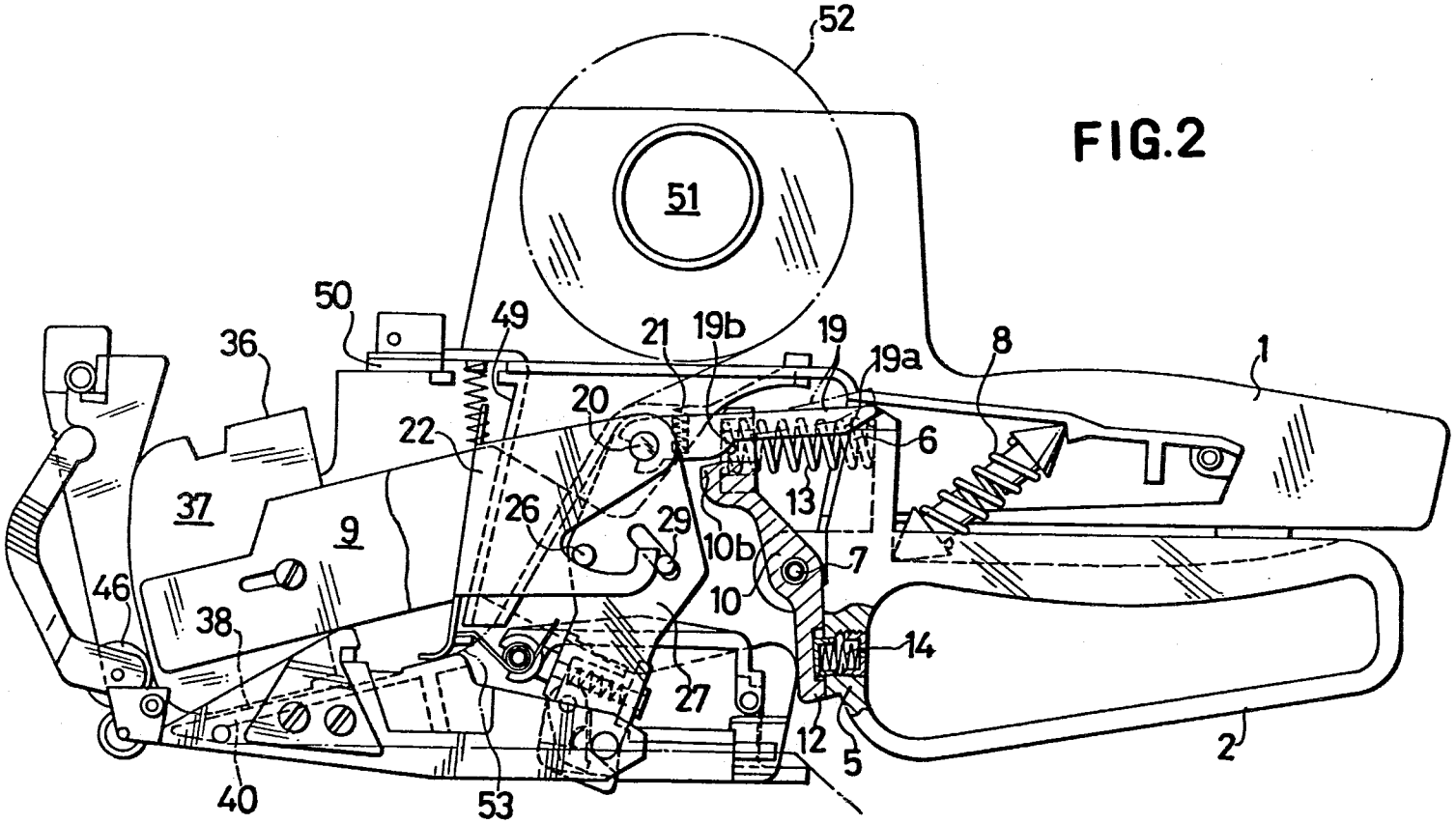
FIG. 2 is a partially cross-sectional, side view of the same machine in a printing position.

The printing head 36 is moved into the printing position of FIG. 2 from the rest position of FIG. 1. When the hand grip 1 and the hand lever 2 are squeezed together, the hand lever 2 is turned counterclockwise about the pivot shaft 7 against the force of the return spring 8 and the constant pressure spring 13. Until the below described action lugs 6 and the below described engaging faces 19*a* contact, the constant pressure spring 13 is compressed and energized by the movement of the hand lever 2.

Then the action lugs 6 on the hand lever 2 come into contact with the engaging faces 19*a* of the action levers 19. As shown in FIG. 2 with dotted lines, the engaging faces 19*a* of action levers 19 are pushed up around the pivot shaft 20 by the action lugs 6 of the hand lever 2, so that the engagement between the engaging recesses 19*b* and the engaging portion 10*b* of the pivoted portion 10 of the printing lever 9 is released.

With such disengagement, the printing lever 9 is turned counterclockwise around the shaft 7 by the release of the constant pressure spring 13 until the type face 38 of the printing head 36 is momentarily pressed against the label on the platen 40 with a constant spring caused printing pressure. Thus, clear printing on the label strip 53 can be attained. During the downward motion of the printing head 36, the inking roller 46 is moved forward against the force of spring 44 and this inks the type face 38 by the rotation of the inking roller 46 on the type face 38. Simultaneously with the downward motion of the printing head 36, the rocking member 27 is turned clockwise about the shaft 20 toward the front portion of the machine from the vertical position by means of the guide pin 29 of the printing lever 9 moving downward.

Figure 3:
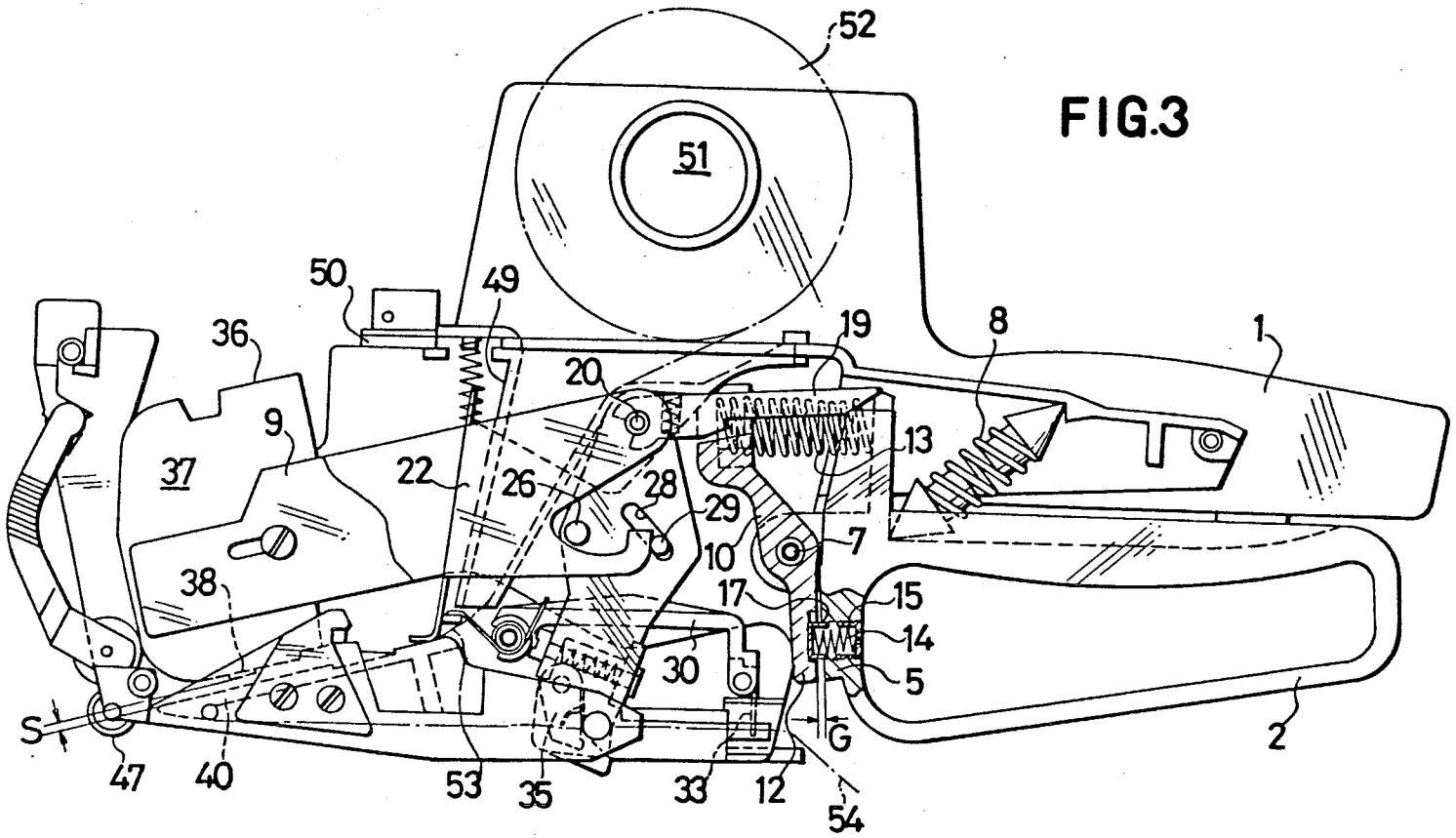
FIG. 3 is a partially cross-sectional, side view of the same machine in which the printing head has been slightly released from the platen immediately after the printing stroke.
Figure 4:
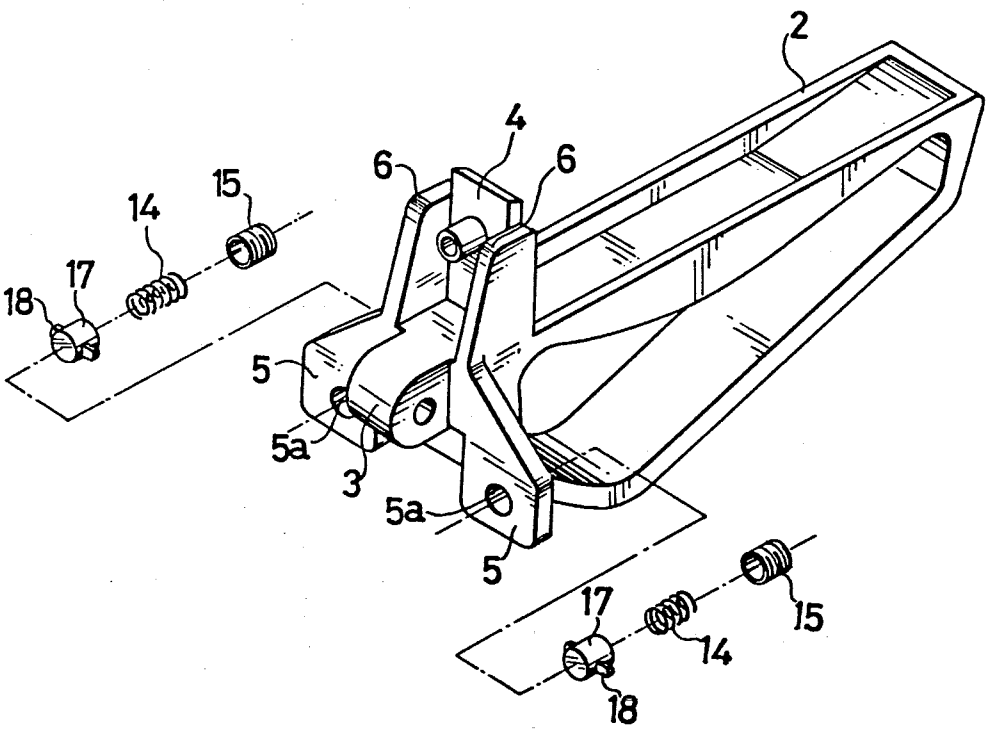
FIG. 4 is an exploded perspective drawing of a hand lever and releasing members.

After the printing action, although the hand lever 2 is still squeezed, the type face 38 of the printing head 36 is separated from the platen 40 as shown in FIG. 3. To do this, the abutments 12 of the pivoted portion 10 of the printing lever 9 are released from the abutments 5 of the hand lever 2 by the force of release springs 14 to form a gap G. Thus, the pivoted portion 10 of the printing lever 9 is turned slightly clockwise about the shaft 7. Accordingly, the printing head 36 that is attached at the tip end of the printing lever 9 is raised off the platen 40. In this releasing action, a small space S is formed between the type face 38 and the surface of the platen 40. In this case, the total spring force of the release springs 14 may be made larger than the force of the constant pressure spring 13 in expanded state and smaller than the force of the same in their compressed charged state.

When the hand lever 2 is then released, the label printing machine returns to the rest position of FIG. 1 from the state of FIG. 3. In this return action, the rocking member 27 is rotated back counterclockwise around the shaft 20 by the guide pin 29 which is interlocked with the returning printing lever 9. In this return motion of the rocking member 27, a certain length of the backing strip 54 peeled from the label strip 53 is shifted by the transferring pawl 35 and the label strip 53 is simultaneously pulled. The pawl 33 of the backing strip arresting member 30 is momentarily raised up from the backing strip 54 so as to facilitate the insertion and pulling out of the backing strip. The rearward counterclockwise movement of the rocking member 27 is stopped by the pressure receiving portion 25 of the label holding member 22 that catches the stop pin 26. Further, the force of the printing lever 9 toward the rest position is received by the pressure receiving portion 50*a* of the label guide 49.

In the following, a second embodiment of the present invention is described with reference to the accompanying drawings, FIGS. 5 to 9, in which corresponding parts of the constant pressure mechanism, the platen 40 and the printing head 36 are indicated with the same reference numerals as those of the first embodiment since their structure and operation are the same.

Figure 5:
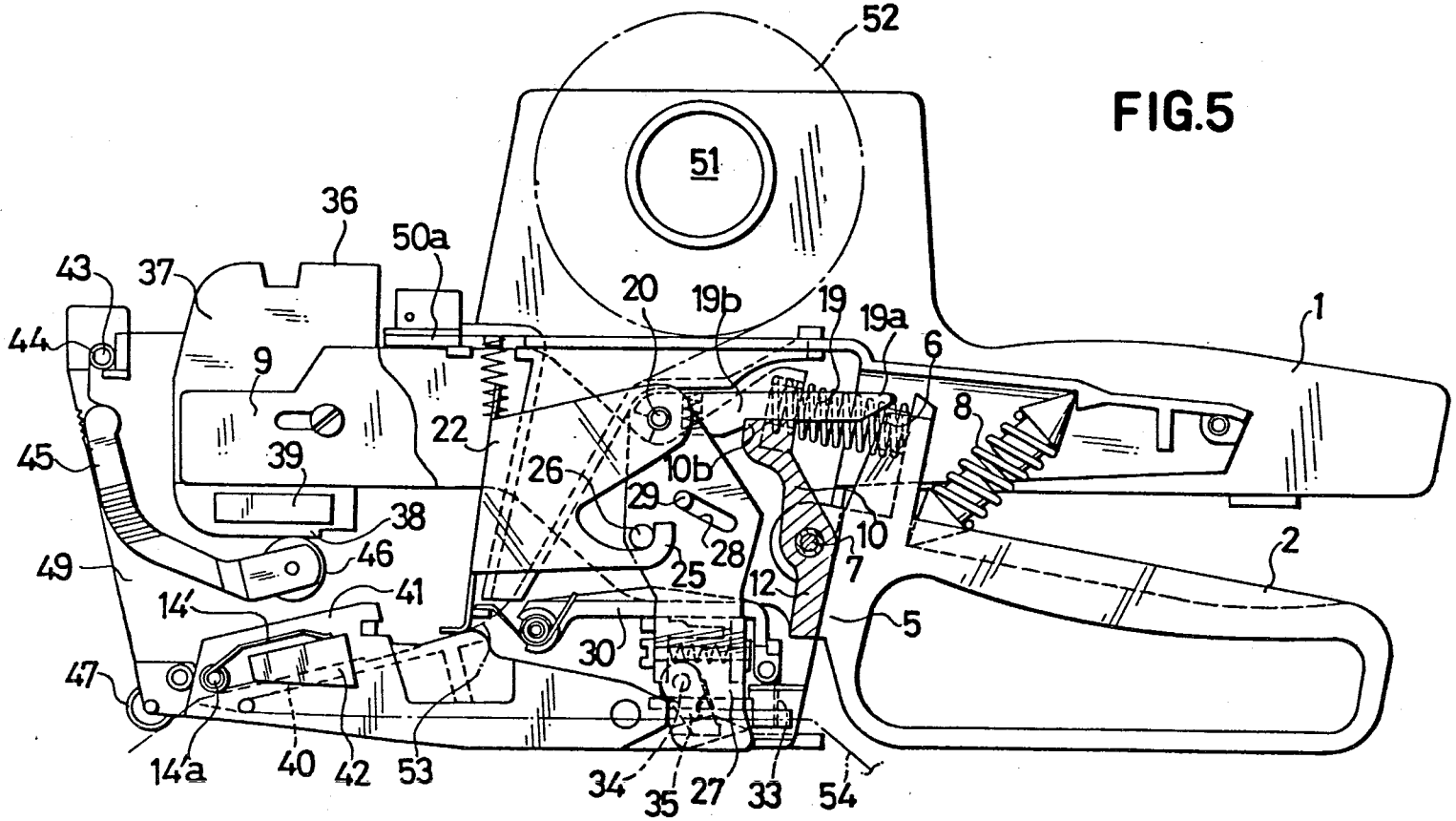
FIG. 5 is a partially cross-sectional, side view of a label printing machine in a rest position and which is provided with a second embodiment of the constant pressure mechanism of the invention.
Figure 6:
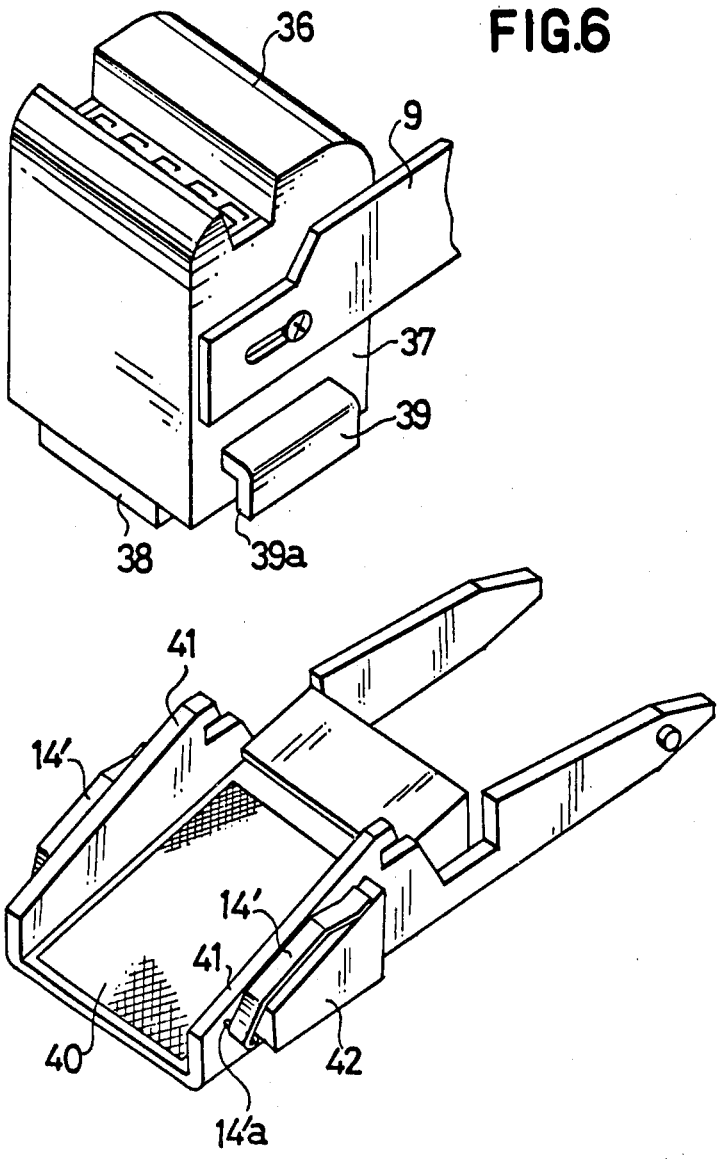
FIG. 6 is a perspective view of a set comprised of a printing head and a platen.

In the releasing means that is worked just after the constant pressure printing, a pair of leaf spring supporting pieces 42 are attached to the side walls 41 of the platen 40, as shown in FIGS. 5 and 6. Each supporting piece 42 supports the free end of each release spring plate 14' that is pivotally secured to the platen side wall 41 with a pin 14'*a*. The lower parts of both side walls 37 of the printing head 36 are provided with cross-sectionally L-shaped action pieces 39 having contact faces 39*a*. During the printing stroke, the contact faces 39*a* of the action pieces 39 are brought into contact with the release spring plates 14'. The above supporting pieces 42 of the platen 40 may be attached on the inside of the side walls 41, and in such a case, the contact faces 39*a* may be formed on the frame body of the printing head 36, so that, whereby the present invention is not restricted to the embodiment shown in the drawings.

Figure 8:
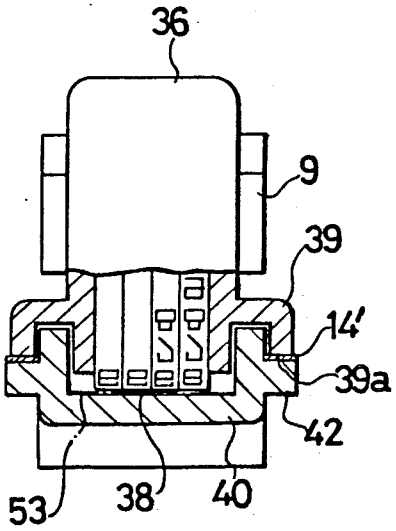
Figure 7:
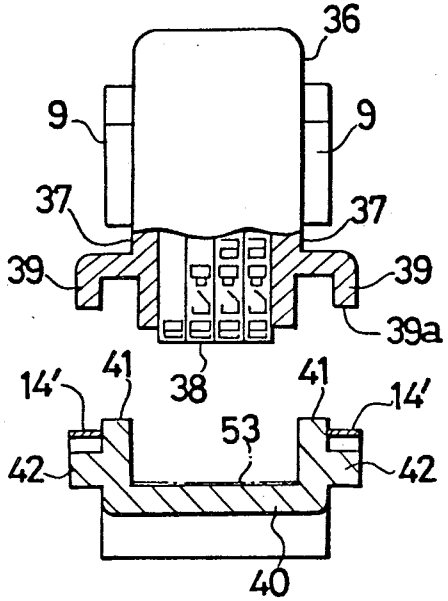

The relative motion between the printing head 36 and the platen 40 is described with reference to the accompanying drawings, FIGS. 7 to 9. When the hand lever is squeezed, the constant pressure spring is actuated and the printing head 36 is moved from the rest position of FIG. 7 to the platen 40 with a constant printing pressure as shown in FIG. 8. Thus, the type face 38 of the printing head 36 is pressed against the label strip 53 on the platen 40 to perform constant-pressure printing. In this printing action, the contact faces 39*a* of action pieces 39 of the printing head 36 depress the release spring plates 14' into a flat or compressed state.

Figure 9:
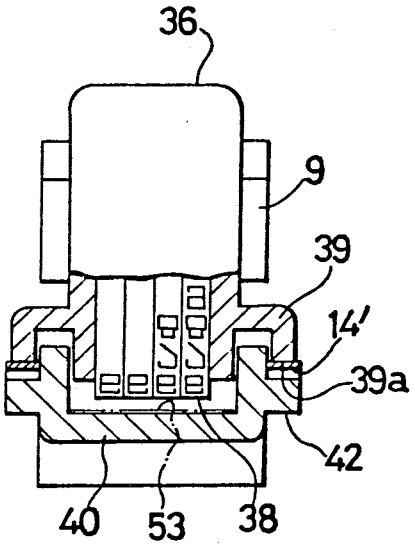

Just after this constant-pressure printing action, the printing head 36 is released from the platen 40 as shown in FIG. 9. With the spring force of the compressed spring plates 14' as well as the reaction force of the printing action, the printing head 36 is momentarily raised slightly from the printing position. Thus, the type face 38 is released from the surface of printed label strip 53 so that the contact time between the printing head 36 and the platen 40 can be made very short and double printing action or ink blurring is prevented from occurring.

In accordance with the present invention, a constant pressure spring is fitted between the hand lever and the printing lever that carries a printing head and the printing head is moved down against the platen by the force of the constant pressure spring. Thus, the printing action is performed with a constant printing pressure. Just after this constant pressure printing, the printing head is slightly released from the printing position by a releasing means. Accordingly, even when the hand lever is squeezed for a long period of time, the printing head is momentarily separated from the platen after the printing action. Further, since the type face of the printing head is not brought into long term contact with the label surface, the blurring of ink and double printing can be avoided. Such clearly printed labels are especially useful for the automatic reading by optical reading machines in POS (point of sales) system.

Although the present invention has been described in connection with preferred embodiments thereof, many variations and modifications will now become apparent to those skilled in the art. It is preferred, therefore, that the present invention be limited, not by the specific disclosure herein, but only by the appended claims.

What is claimed is:

1. A constant printing pressure mechanism for a label printing machine, comprising:

a frame for supporting all elements of said constant printing mechanism;

an operating lever pivotable between an operating position and a released position; an operating lever pivot shaft on said frame for said operating lever whereby said operating lever pivots between its said positions;

a printing lever pivotable toward and away from a printing position; a respective printing lever pivot shaft on said frame for said printing lever, whereby said printing lever pivots between its said positions; a printing head carried on and pivotable with said printing lever;

a constant printing pressure spring connected between said operating lever and said printing lever and being chargeable upon pivoting of said operating lever toward said operating position; upon discharge of said spring, said spring biasing said printing lever to pivot toward said printing position;

restraining means for restraining pivoting motion of said printing lever to said printing position; restraining means disconnect means on said operating lever for disconnecting said restraining means for restraining motion of said printing lever after predetermined pivoting motion of said operating lever toward its said operating position, whereby said constant pressure spring is charged before said restraining means is released and said printing lever is free to pivot under the bias of the discharge of said constant printing pressure spring after said restraining means have been released;

a platen positioned to be engaged by said printing head as said printing lever pivots to said printing position; means for interposing a label to be imprinted between said printing head and said platen;

printing head release means for separating said printing head from said platen after said printing head had engaged said platen under the influence of said constant printing pressure spring.

2. The constant printing pressure mechanism of claim 1, wherein said printing head release means comprises a release spring connected with said printing lever when said printing head moves near said platen, and said release spring being charged when said printing head engages said platen;

a separate operating lever return spring connected with said operating lever for returning it to said released position.

3. The constant printing pressure mechanism of claim 2, wherein said release spring is chargeable with a biasing force that is less than the biasing force that is exerted by the charged said constant printing pressure spring upon release of said printing lever, and the biasing force of said release spring when charged being greater than the biasing force of said constant printing pressure spring after said constant printing pressure spring has discharged and said printing head is engaging said platen.

4. The constant printing pressure mechanism of claim 3, further comprising means for adjusting the biasing force exerted by said release spring upon said printing head engaging said platen.

5. The constant printing pressure mechanism of claim 2, wherein said restraining means comprises an arm movable between a position where it blocks the pivoting motion of said printing lever to said printing position and to a disconnect position at which is no longer blocks such pivoting motion of said printing lever;

said restraining means disconnect means comprising a portion of said operating lever which is normally out of engagement with said restraining means and which is pivotable along with said operating lever into engagement with said restraining means arm, and said operating lever portion and said restraining means arm being respectively shaped and positioned so that engagement therebetween lifts said restraining means arm to position where it ceases to restrain said printing lever from pivoting to said printing position.

6. The constant printing pressure mechanism of claim 5, wherein said restraining means arm is pivotally attached to said frame for pivoting between its respective positions;

said operating lever portion being away from said operating lever pivot shaft, whereby said operating lever portion sweeps through a pivot arc as it moves with said operating lever.

7. The constant printing pressure mechanism of claim 2, wherein said release spring is positioned at said platen and said printing head engages said release spring as said printing head approaches said platen, and said printing head charges said release spring as said printing head approaches said platen and contacts said platen.

8. The constant printing pressure mechanism of claim 1, wherein said pivot shafts for said operating lever and said printing lever are the same said shaft.

9. A constant printing pressure mechanism for a label printing machine, comprising:

a frame for supporting all elements of said constant printing mechanism;

an operating lever pivotable between an operating position and a released position; an operating lever pivot shaft on said frame for said operating lever whereby said operating lever pivots between its said positions;

a printing lever pivotable toward and away from a printing position; a respective printing lever pivot shaft on said frame for said printing lever, whereby said printing lever pivots between its said positions; a printing head carried on and pivotable with said printing lever;

a constant printing pressure spring connected between said operating lever and said printing lever and being chargeable upon pivoting of said operating lever toward said operating position; upon discharge of said spring, said spring biasing said printing lever to pivot toward said printing position;

restraining means for restraining pivoting motion of said printing lever to said printing position; restraining means disconnect means on said operating lever for disconnecting said restraining means for restraining motion of said printing lever after predetermined pivoting motion of said operating lever toward its said operating position, whereby said constant pressure spring is charged before said restraining means is released and said printing lever is free to pivot under the bias of the discharge of said constant printing pressure spring after said restraining means has been released;

a platen positioned to be engaged by said printing head as said printing lever pivots to said printing position; means for interposing a label to be imprinted between said printing head and said platen;

printing head release means for separating said printing head from said platen after said printing head has engaged said platen under the influence of said constant printing pressure spring; said printing head release means comprises a release spring connected with said printing lever when said printing head moves near said platen, and said release spring being charged when said printing head engages said platen;

said operating lever and said printing lever are provided with respective opposed abutments; said release spring being connected between said opposed abutments for normally urging said abutments and their respective said levers so as to urge said printing lever to lift said printing head away from said platen.

10. The constant printing pressure mechanism of claim 9, further comprising means for adjusting the biasing force exerted by said release spring upon said printing head engaging said platen.

11. The constant printing pressure mechanism of claim 10, wherein said operating lever and said printing lever are provided with respective opposed abutments; said release spring being connected between said abutments for normally urging said abutments and their respective said levers so as to urge said printing lever to lift said printing head away from said platen.

12. The constant printing pressure mechanism of claim 11, wherein said release spring adjustment means is attached to one of said abutments.

* * * * *